US008616864B2

(12) United States Patent
Nakamura et al.

(10) Patent No.: US 8,616,864 B2
(45) Date of Patent: Dec. 31, 2013

(54) AXIAL FLOW FAN

(75) Inventors: Toshiyuki Nakamura, Nagano (JP); Masahiro Koike, Nagano (JP); Naoya Inada, Nagano (JP)

(73) Assignee: Sanyo Denki Co., Ltd., Tokyo (JP)

( * ) Notice: Subject to any disclaimer, the term of this patent is extended or adjusted under 35 U.S.C. 154(b) by 287 days.

(21) Appl. No.: 13/001,503

(22) PCT Filed: Jun. 15, 2009

(86) PCT No.: PCT/JP2009/060903
§ 371 (c)(1),
(2), (4) Date: Dec. 27, 2010

(87) PCT Pub. No.: WO2009/157338
PCT Pub. Date: Dec. 30, 2009

(65) Prior Publication Data

US 2011/0097226 A1 Apr. 28, 2011

(30) Foreign Application Priority Data

Jun. 26, 2008 (JP) ..... 2008-167032

(51) Int. Cl.
*F04B 35/04* (2006.01)

(52) U.S. Cl.
USPC ..... 417/423.14; 174/97

(58) Field of Classification Search
USPC ..... 417/423.14; 415/213.1, 214.1; 174/97
See application file for complete search history.

(56) References Cited

U.S. PATENT DOCUMENTS 6,174,145 B1 * 1/2001 Taniguchi ..... 417/423.14
6,388,196 B1 * 5/2002 Liu et al. ..... 174/135

(Continued)

FOREIGN PATENT DOCUMENTS

CN 2886153 Y 4/2007
JP 11-072098 3/1999

(Continued)

OTHER PUBLICATIONS

Chinese Office Action with English Summary Translation, dated May 24, 2013, 8 pages.

*Primary Examiner* — Devon Kramer
*Assistant Examiner* — Joseph Herrmann
(74) *Attorney, Agent, or Firm* — Rankin, Hill & Clark LLP

(57) ABSTRACT

An axial flow fan provided herein allows for a wide range of selection for placement of the fan and wiring of the lead wires. The axial flow fan includes a first lead wire engaging portion 17 configured to be engaged with a plurality of lead wires 15 such that the lead wires are pulled out therefrom into an outer space OS defined between a first flange 21 and a second flange 23 of a fan housing 3, a second lead wire engaging portion 19 configured to be engaged with the plurality of lead wires 15 such that the lead wires, which have been engaged with the first lead wire engaging portion 17 and pulled out therefrom into the outer space OS, are then pulled out toward the other side in the axial direction where the second flange 23 is positioned, and a third lead wire engaging portion 27 configured to be engaged with the plurality of lead wires 15 such that the lead wires, which have been engaged with the first lead wire engaging portion 17 and pulled out therefrom into the outer space OS, are then pulled out in the axial direction toward one side where the first flange 21 is positioned. The third lead wire engaging portion 27 is formed in the first flange 21 at a given distance from the first lead wire engaging portion 17.

3 Claims, 7 Drawing Sheets

(56) References Cited

U.S. PATENT DOCUMENTS

| | | | | |
|---|---|---|---|---|
| 8,007,233 | B2 * | 8/2011 | Yang et al. | 415/213.1 |
| 8,007,234 | B2 * | 8/2011 | Yoshida | 415/222 |
| 2007/0041857 | A1 * | 2/2007 | Fleig | 417/423.14 |
| 2007/0134091 | A1 * | 6/2007 | Chu et al. | 415/220 |
| 2007/0274821 | A1 | 11/2007 | Yoshida | |
| 2008/0152489 | A1 * | 6/2008 | Alex et al. | 415/213.1 |

FOREIGN PATENT DOCUMENTS

| | | |
|---|---|---|
| JP | 2000-64987 | 3/2000 |
| JP | 2007-309313 | 11/2007 |

* cited by examiner (A)

(B)

(A)

(B)

AXIAL FLOW FAN

TECHNICAL FIELD

The present invention relates to an axial flow fan typically used to cool the inside of an electric apparatus.

BACKGROUND ART

Japanese Patent Application Publication No. 2007-309313 (JP2007-309313A, FIG. 1) discloses an axial flow fan which includes a fan housing including a first flange formed on one side in the axial direction of the axial flow fan where a discharge port is positioned, a second flange formed on the other side in the axial direction where a suction port is positioned, and a cylindrical portion formed between the first flange and the second flange. A first lead wire engaging portion is formed in the first flange to be engaged with a plurality of lead wires such that the lead wires are pulled out therefrom into an outer space defined between the first flange and the second flange. A second lead wire engaging portion is formed in the second flange to be engaged with the plurality of lead wires, which have been pulled out into the outer space, such that they are then pulled out toward the suction port.

DISCLOSURE OF THE INVENTION

Technical Problem

In the conventional axial flow fan mentioned above, the plurality of lead wires are pulled out in the axial direction toward the suction port. With such configuration, if it is difficult to pull out the lead wires toward the suction port due to the placement of the axial flow fan, for example, when the lead wires need to be pulled out toward the discharge port in the axial direction of the axial flow fan, wiring of the lead wires becomes complicated. In the conventional axial flow fan, lead wires pulled out toward the suction port may be in contact with an impeller, or lead wires pulled around a long way toward the suction port may be blown by the wind, thereby causing noise.

An object of the present invention is to provide an axial flow fan in which lead wires may be pulled out toward either side of the fan where a suction port is positioned or a discharge port is positioned.

Another object of the present invention is to provide an axial flow fan capable of reducing noise.

Still another object of the present invention is to provide an axial flow fan in which lead wires may securely be pulled into a space outside the fan even if a plurality of axial flow fans are used.

Solution to Problem

An axial flow fan according to the present invention includes a fan housing, an impeller, a motor including a rotor and a stator, a motor casing, a plurality of webs in one of which a groove portion is formed, a plurality of lead wires, a first lead wire engaging portion, and a second lead wire engaging portion. The fan housing includes a first flange positioned on one side of a rotary shaft in an axial direction of the rotary shaft, a second flange positioned on the other side of the rotary shaft in the axial direction, and a cylindrical portion provided between the first flange and the second flange. The fan housing has an air channel defined by an inner space formed by the first flange, the second flange and the cylindrical portion, and the air channel has a suction port and a discharge port.

The impeller is disposed in the air channel and has a plurality of blades. The rotor to which the impeller is fixed rotates about the rotary shaft, and a stator is provided with respect to the rotor. The motor is configured to rotate the rotor and is received in a motor casing. The motor casing includes a bottom wall portion located within the first flange and a peripheral wall portion formed continuous with the bottom wall portion and extending toward the second flange.

The plurality of webs are disposed at intervals in a direction of rotation of the impeller and located within the air channel to connect the motor casing and the first flange. The groove portion is formed in one of the webs to allow an internal space of the motor casing to communicate with an outer space of the fan housing. The plurality of lead wires are received in the groove portion that is formed in the one of the webs and connected to a power supply circuit of the motor, and extend toward the outer space of the fan housing.

The first lead wire engaging portion is formed in a connecting portion between the first flange and the one of the webs to be engaged with the plurality of lead wires such that the lead wires are pulled out from the first lead wire engaging portion into an outer space defined between the first flange and the second flange of the fan housing and located outside the cylindrical portion of the fan housing. The second lead wire engaging portion is formed in the second flange to be engaged with the plurality of lead wires such that the plurality of lead wires, which have been engaged with the first lead wire engaging portion and pulled out therefrom into the outer space, are then pulled out toward the other side of the rotary shaft in the axial direction where the second flange is positioned.

A third lead wire engaging portion is formed in the first flange at a given distance from the first lead wire engaging portion to be engaged with the plurality of lead wires such that the lead wires, which have been pulled out from the first lead wire engaging portion into the outer space, are then pulled out toward the one side in the axial direction where the first flange is positioned. In this manner, when the third lead wire engaging portion is provided in the first flange at a given distance from the first lead wire engaging portion with respect to the second lead wire engaging portion provided in the second flange, the lead wires may be pulled out not only toward the side where the second flange is provided but also toward the side where the first flange is provided. Namely, according to the present invention, the lead wires may be pulled toward either side in the axial direction. Also, a plurality of lead wires may be divided and separately pulled out toward both sides in the axial direction. Thus, the axial flow fan according to the present invention allows for a wider range of selection for placement of the axial flow fan and pulling out or wiring direction of the lead wires. Further, owing to the third lead wire engaging portion, base portions of the pulled-out lead wires may firmly be secured when the plurality of lead wires are pulled out toward one side in the axial direction. Thus the lead wires may be prevented from being wound into the impeller when they come into contact with the impeller. Also, noise may be prevented from being generated due to the existence of the lead wired on the other side in the axial direction.

The second lead wire engaging portion formed in the second flange and the third lead wire engaging portion formed in the first flange may face each other in the axial direction. When the second and third lead wire engaging portions are formed in positions where they face each other in the axial direction, multiple axial flow fans of the same shape may be used by arranging the axial flow fans in the axial direction such that the second lead wire engaging portion provided on one of adjoining two axial flow fans may be adjacent to the third lead wire engaging portion provided on the other axial flow fan. As a result, when two axial flow fans are used by arranging them in the axial direction such that one side of one of the two axial flow fans where the second lead wire engaging portion is formed is in contact with one side of the other axial flow fan where the first lead wire engaging portion is formed, the lead wires engaged with the second lead wire engaging portion of one of the axial flow fan may be engaged with the third lead wire engaging portion and the second lead wire engaging portion of the other axial flow fan adjacent to the one axial flow fan. As a result, the lead wires of the one axial flow fan may be pulled out in the axial direction toward the side where the second lead wire engaging portion of the other axial flow fan is positioned through the third and second lead wire engaging portions of the other axial flow fan. Namely, even when a plurality of axial flow fans of the same shape are used by arranging them in the axial direction, the lead wires may securely be pulled out in the axial direction into a space outside the fan, regardless of whichever side the first and second lead wire engaging portions are formed on.

Preferably, the first flange and the second flange may have a substantially quadrangular outline shape as seen in the axial direction. Also preferably, the first lead wire engaging portion and the third lead wire engaging portion may be formed in one side of the quadrangular outline of the first flange while the second lead wire engaging portion be formed in one side of the quadrangular outline of the second flange, opposed to the side of the first flange where the first and the third lead wire engaging portions are formed. With such configuration, the third lead wire engaging portion is disposed in the vicinity of the first lead wire engaging portion. Accordingly, the lead wires need not be longer than necessary when the lead wire is to be pulled out in the axial direction toward a side where the first lead wire engaging portion is formed. Further, when the second lead wire engaging portion is located adjacent to the third lead wire engaging portion in the axial direction under the above-discussed condition, the lead wires need not be longer than necessary when multiple axial flow fans of the same shape are used by arranging them in the axial direction as mentioned above.

The first lead wire engaging portion may be constituted from a first through-hole formed in the first flange to pass therethrough in the axial direction and communicating with the groove portion of the one of the webs, and a first slit formed in the first flange to communicate with the first through-hole, passing through the first flange in the axial direction, and opened to an outer peripheral surface of the first flange. The second lead dire engaging portion may be constituted from a second through-hole formed in the second flange to pass therethrough in the axial direction, and a second slit formed in the second flange to communicate with the second through-hole, passing through the second flange in the axial direction, and opened in an outer peripheral surface of the second flange. The third lead wire engaging portion may be constituted from a third through-hole formed in the first flange to pass therethrough in the axial direction, and a third slit formed in the first flange to communicate with the third through-hole, passing through the first flange in the axial direction, and opened to the outer peripheral surface of the first flange.

The first slit may be dimensioned so that the plurality of lead wires engaged with the first lead wire engaging portion and passing through the first through-hole may not readily come off from the first slit. The second slit may be dimensioned so that the plurality of lead wires engaged with the second lead wire engaging portion and passing through the second through-hole may not readily come off from the second slit. The third slit may be dimensioned so that the plurality of lead wires engaged with the third lead wire engaging portion and passing through the third through-hole may not readily come off from the third slit. When the first to third lead wire engaging portions are configured in this manner, a plurality of lead wires may be engaged with the first to third lead wire engaging portions merely by inserting the plurality of lead wires through the first to third slits into the first to third through-holes respectively. Thus engagement of the plurality of lead wires is simplified. Further, once the lead wires have been engaged with the engaging portions, that is, the lead wires have been inserted within the first to third through-holes, the lead wires may securely be engaged with the first to third lead wire engaging portions since the lead wires do not readily come off from the first to third slits.

BRIEF DESCRIPTION OF THE DRAWINGS

FIG. 6(A) is a perspective view of the axial flow fan as viewed from the front of the fan, and FIG. 6(B) is a perspective view of FIG. 6(A) as viewed from the rear of the fan.

FIG. 7(A) is a perspective view of the axial flow fan as viewed from the front of the fan, and FIG. 7(B) is a perspective view of FIG. 7(A) as viewed from the rear of the fan.

BEST MODE FOR CARRYING OUT THE INVENTION

An embodiment of an axial flow fan according to the present invention will be described in detail below with reference to the drawings.

Figure 1:
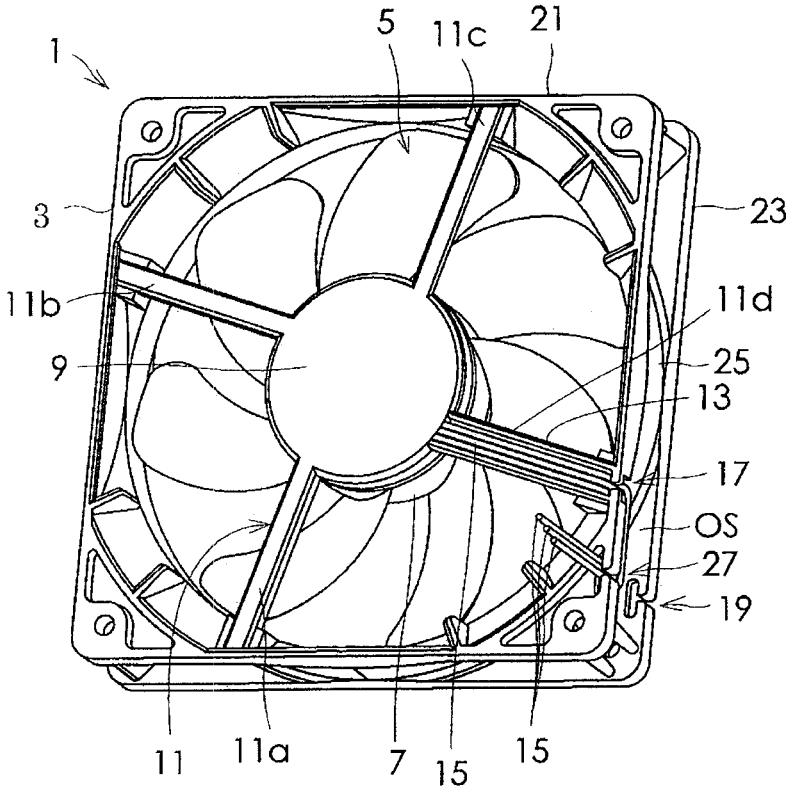
FIG. 1 is a perspective view of an axial flow fan according to an embodiment of the present invention, as viewed from the front of the fan.
Figure 2:
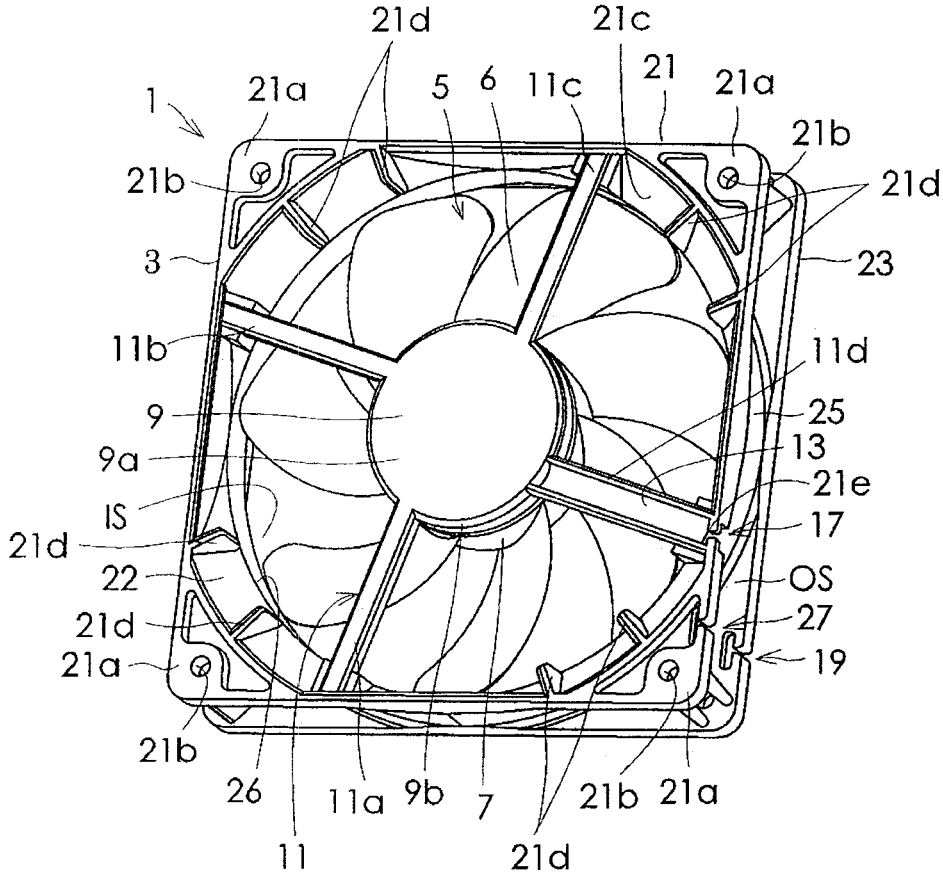
FIG. 2 is the same view same as FIG. 1 except that lead wires are omitted.

FIG. 1 is a perspective front view of an axial flow fan according to an embodiment of the present invention. FIG. 2 is the same view of FIG. 1 except that lead wires are omitted. FIG. 3(A) is a font view of the axial flow fan of FIG. 2, and FIG. 3(B) is a partially enlarged view of FIG. 3(A). FIG. 4(A) is a right side view of FIG. 3(A), and FIG. 4(B) is a partially enlarged view of FIG. 4(A). FIG. 5(A) is a rear view of FIG. 3(A), and FIG. 5(B) is a partially enlarged view of FIG. 5(A). In these views, reference numeral 1 denotes an axial flow fan. The axial flow fan 1 includes a fan housing 3, an impeller 5, a motor (not illustrated), including a rotor 7 and a stator (not illustrated), a motor casing 9, a plurality of webs 11 (four webs 11*a* to 11*d*), a groove portion 13, a plurality of lead wires 15, a first lead wire engaging portion 17, and a second lead wire engaging portion 19.

The fan housing 3 includes a first flange 21, a second flange 23, and a cylindrical portion 25. The first flange 21 is formed in an annular shape, provided on one side in an axial direction of a not-illustrated rotary shaft of the axial flow fan, that is, on a side where an after-mentioned discharge port is positioned. As shown in FIG. 2 and FIG. 3A, the first flange 21 has a substantially quadrangular outline shape as seen in the axial direction, that is, as viewed from the front of the axial flow fan 1. The first flange 21 has an approximately circular discharge opening 22 that defines a discharge port of the axial flow fan 1. The first flange 21 includes four flat surfaces 21*a* on the four corner portions thereof, each having a through-hole 21*b* through which a fixing screw, not illustrated, is threaded.

The second flange 23 is formed in an annular shape on the other side in the axial direction, that is, a side where an after-mentioned suction port is positioned. According to the present embodiment, a taper portion 21*c* is formed to slope down to the cylindrical portion 25 in a portion of the first flange 21 where an air channel 25 is defined. Eight stationary blades 21*d* are formed in the taper portion 21*c* at given intervals in a direction of rotation of the impeller. The second flange 23 has a substantially quadrangular outline shape as seen in the axial direction of FIG. 5A, that is, as viewed from the rear of the axial flow fan 1. The second flange 23 has an approximately circular suction opening 24 that defines a suction port of the axial flow fan 1. The second flange 23 also includes four flat surfaces 23*a* on the four corner portions thereof, each having a through-hole 23*b* through which a not-illustrated fixing screw is threaded.

The cylindrical portion 25 is provided between the first flange 21 and the second flange 23. According to the present embodiment, the fan housing 3 has an air channel 26 defined by an inner space IS formed by the first flange 21, the second flange 23 and the cylindrical portion 25. The air channel 26 has a suction port or the suction opening 24 and a discharge port or the discharge opening 22.

In the present embodiment, a side where the first flange 2 of the fan housing 3 is positioned defines a side where the discharge port or the discharge opening 22 of the axial flow fan 1 is positioned. A side where the second flange 23 of the fan housing 3 is positioned defines a side where the suction port or the suction opening 24 of the axial flow fan 1 is positioned. However, positioning of the suction port or the suction opening 24 and a discharge port or the discharge opening 22 are not limited to the configuration of the present embodiment. A side where the first flange is positioned may define a side where the suction port or the suction opening 24 of the axial flow fan 1 is positioned. A side where the second flange is positioned may define a side where the discharge port or the discharge opening 22 of the axial flow fan 1 is positioned.

The impeller 5 including a plurality of blades 6 is disposed inside the air channel 26. The impeller 5 is fixed to the rotor 7 operable to rotate about the rotary shaft, not illustrated. The impeller 5 is rotated inside the air channel 26 by the rotation of the rotor 7 driven by a not-illustrated motor. According to the present embodiment, a not-illustrated stator is provided with respect to the rotor 7. The not-illustrated motor is received inside a motor casing 9 which includes a bottom wall portion 9*a* located within the first flange 21 and a peripheral wall portion 9*b* that is formed continuous with the bottom wall portion 9*a* and extend toward the suction port or the suction opening 24.

Figure 3:
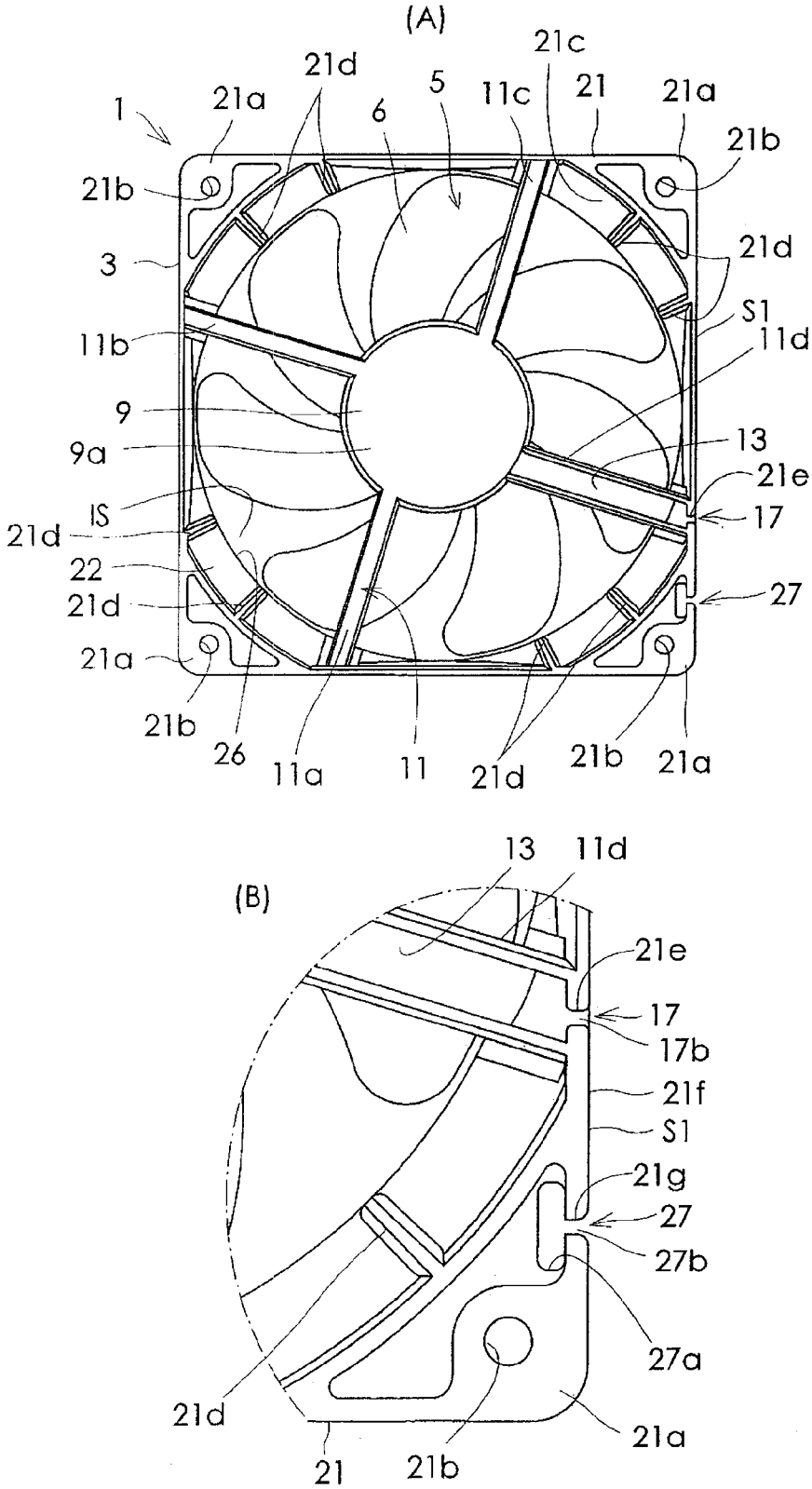
FIG. 3(A) is a front view of the axial flow fan of FIG. 2.
FIG. 3(B) is a partially enlarged view of FIG. 3(A).

As shown in FIGS. 1 to 3, the plurality of webs 11 are constituted from four webs 11*a* to 11*d*. The four webs 11*a* to 11*d* are disposed within the air channel 26 at intervals in the direction of rotation of the impeller 5 so as to connect the motor casing 9 and the first flange 21. One of the four webs 11*a* to 11*d*, that is, the web 11*d*, has a groove portion 13 formed therein. The groove portion 13 communicates with an internal space of the motor casing 9 and also with an outer space of the fan housing 3. The groove portion 13 provided in the web 11*d* receives a plurality of lead wires 15, which are connected to a power supply circuit of the not-illustrated motor and extend toward an outers space of the fan housing 3. Refer to FIG. 1.

A first lead wire engaging portion 17 is formed in a connecting portion 21*e* between the first flange 21 and the web 11*d*. The first lead wire engaging portion 27 is configured to allow the plurality of lead wires 15 to be engaged therewith and pulled out therefrom to an outer space OS defined between the first flange 21 and the second flange 23 of the fan housing 3. The second lead wire engaging portion 19 is formed in the second flange 23 and configured to allow the plurality of lead wires 15, which have been engaged with the first lead wire engaging portion 17 and pulled out into the outer space OS, to be engaged with the second lead wire engaging portion 19 and then pulled out toward the other side in the axial direction where the second flange 23 is positioned, that is, a side where the suction port is positioned.

The axial flow fan 1 according to the present embodiment further includes a third lead wire engaging portion 27 in addition to the first and second lead wire engaging portions 17 and 19. The third lead wire engaging portion 27 is configured to allow the plurality of lead wires 15, which have been engaged with the first lead wire engaging portion 17 and pulled out to the outer space OS, to be engaged with the third lead wire engaging portion 27 and then pulled out therefrom in the axial direction toward the one side where the first flange 21 is positioned, that is, a side where the discharge port is positioned. As shown in FIGS. 1 to 3, the third lead wire engaging portion 27 is formed in the first flange 21 at a given distance from the first lead wire engaging portion 17. The distance between the first lead wire engaging portion 17 and the third lead wire engaging portion 27 may arbitrarily be determined.

Accordingly, when the third lead wire engaging portion 27 is formed in addition to the first and second lead wire engaging portions 17 and 19, it becomes possible to pull out the plurality of lead wires 15 not only toward the side where the second flange 23 is positioned, that is, the side in the axial direction of the fan where the suction port is positioned but also toward the side where the first flange 21 is positioned, that is, the side in the axial direction of the fan where the discharge port is positioned. This allows for a wide range of selection for placement of the axial flow fan 1 and wiring of the lead wires 15. In addition, the presence of the third lead wire engaging portion 27 makes it possible to pull out the plurality of lead wires 15 toward the side in the axial direction where the discharge port or the discharge opening 22 is positioned. Thus, it may become possible to solve conventional issues, such as involvement of the lead wires 15 into the impeller 5 due to the presence of the lead wires 15 pulled out in the axial direction to the side where the suction port or the suction opening 24 is positioned, and noise caused by the presence of lead wires 15 on the side where the suction port or the suction opening 24 is positioned.

Figure 4:
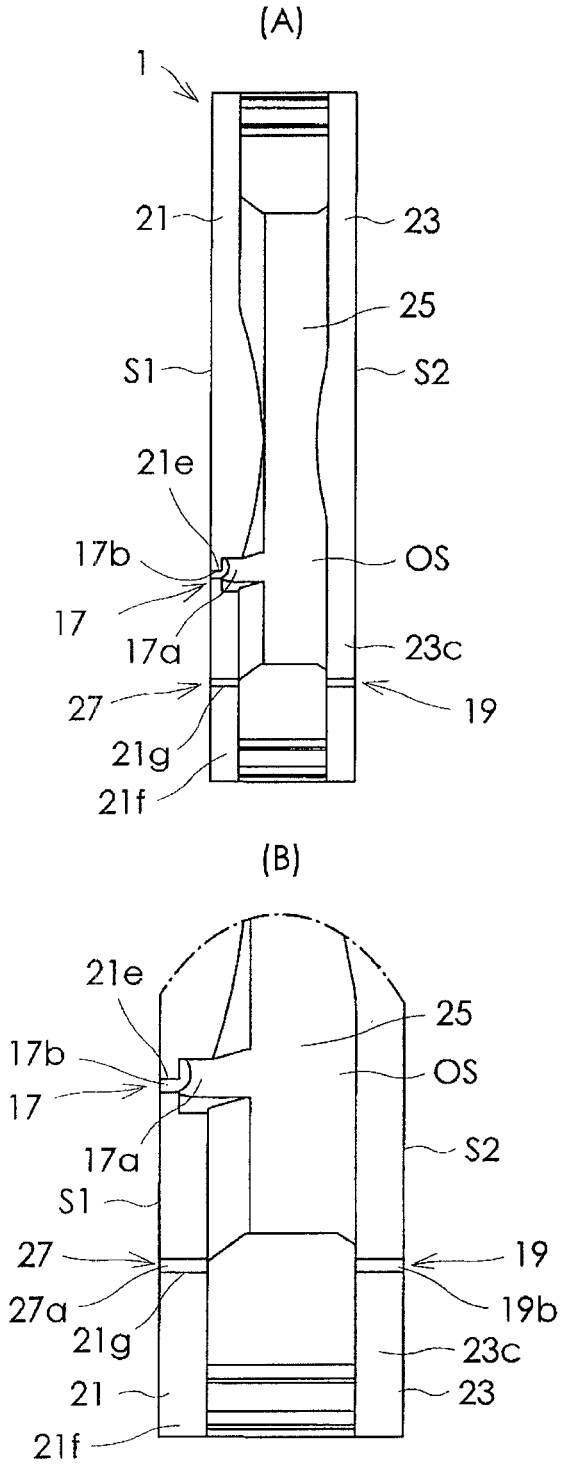
FIG. 4(A) is a right side view of FIG. 3(A)
FIG. 4(B) is a partially enlarged view of FIG. 4(A).

In particular according to the present embodiment, as shown in FIGS. 1, 2 and 4, the second lead wire engaging portion 19 is formed in the second flange 23 and the third lead wire engaging portion 27 is formed in the first flange 21 to face each other in the axial direction. When the second lead wire engaging portion 19 and the third lead wire engaging portion 27 face each other in the axial direction, the following effects may be obtained when two axial flow fans of the same shape are used by arranging them in the axial direction. Here, one of the axial flow fans is designated at 1 and the other axial flow fan is designated at 1'. Those components of the other axial flow fan 1' which are common to those of the axial flow fan 1 are designated with the same reference numerals suffixed by an apostrophe ('). When the two axial flow fans 1 and 1' are used by arranging them in the axial direction such that the second flange 23 of the one axial flow fan 1 and the first flange 21' of the other axial flow fan 1' are adjacent to each other, the second lead wire engaging portion 19 formed on the side where the suction port or the suction opening 24 of the axial flow fan 1 is positioned and the third lead wire engaging portion 27' formed on the side where the discharge port or the discharge opening 22' of the other axial flow fan 1' is positioned are adjacent to each other in the axial direction.

Figure 6:
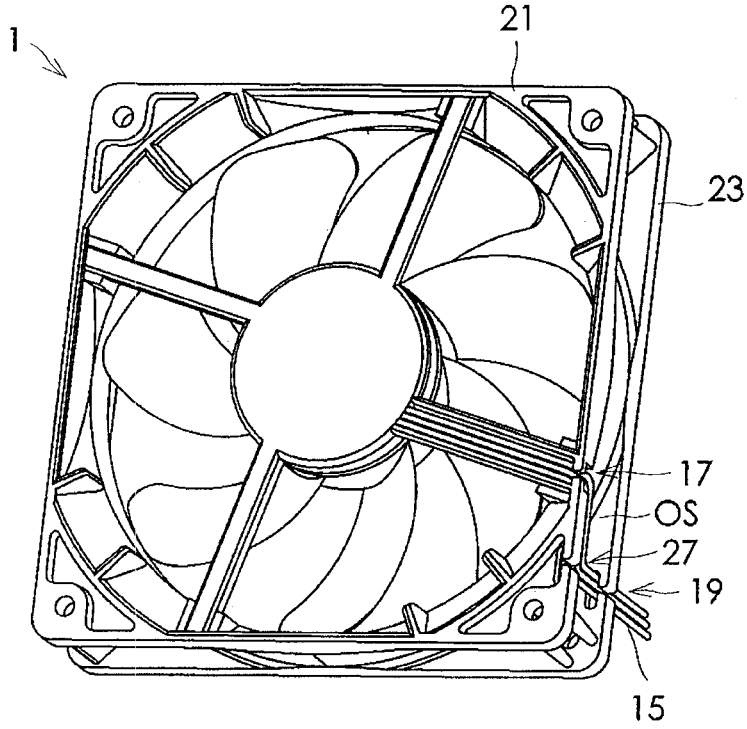
FIG. 6 illustrates engagement of a plurality of lead wires in an axial flow fan according to the embodiment of the present invention.
Figure 6:
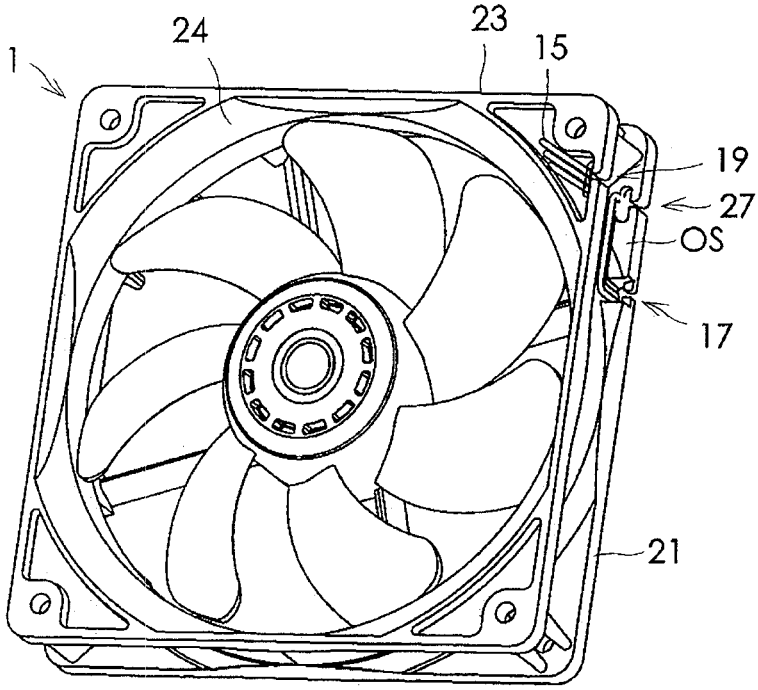
Figure 7:
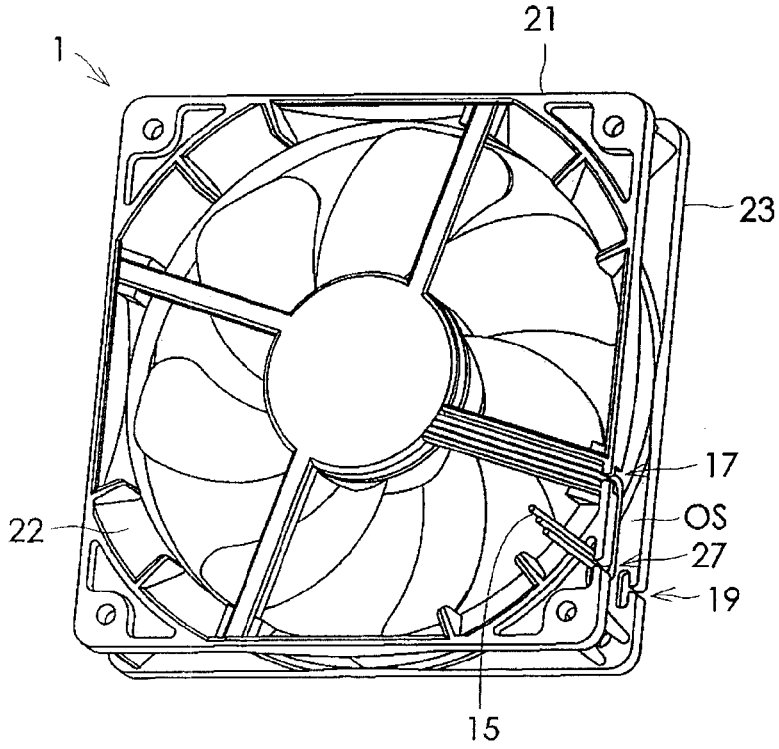
FIG. 7 illustrates engagement of the plurality of lead wires in an axial flow fan according to another example of the present invention.
Figure 7:
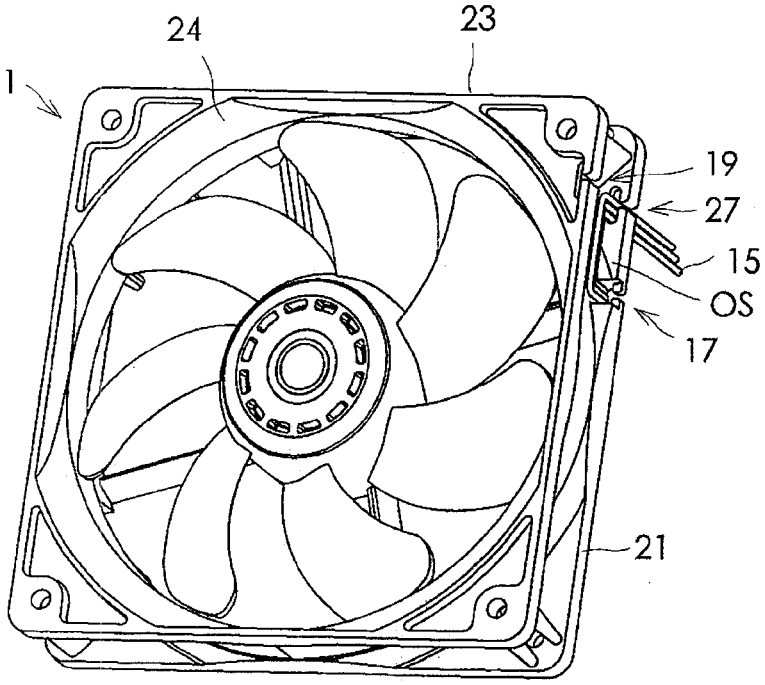

As a result, the plurality of lead wires 15, which are engaged with the second lead wire engaging portion 19 provided on the side of the suction port of the axial flow fan 1, may be engaged with the third lead wire engaging portion 27' provided on the side of the discharge port of the other axial flow fan 1' adjacent to the one axial flow fan 1 and also engaged with the second lead wire engaging portion 19' provided on the side of the suction port of the axial flow fan 1'. Accordingly, the plurality of lead wires 15 of the axial flow fan 1 may be pulled out in the axial direction toward the side of the suction port or the suction opening 24' of the other axial flow fan 1' through the third and the second lead wire engaging portions 27' and 19' of the other axial flow fan 1'. Refer to FIG. 6. Alternatively, the plurality of lead wires 15', which are engaged with the third lead wire engaging portion 27' on the side of the discharge port of the other axial flow fan 1' may be engaged with the second lead wire engaging portion 19 provided on the side of the suction port of the axial flow fan 1 adjacent to the discharge port of the other axial flow fan 1', and engaged with the third lead wire engaging portion 27 provided on the side of the discharge port. Accordingly, the plurality of lead wires 15' of the other axial flow fan 1' may be pulled out in the axial direction toward the side of the discharge port or the discharge opening 22 of the axial flow fan 1 through the second and third lead wire engaging portions 19 and 27 of the axial flow fan 1. Refer to FIG. 7. As a result, even when two or more axial flow fans 1 and 1' of the same shape are used by arranging them in the axial direction, the plurality of lead wires 15 may securely be pulled out on either side of the axial direction toward a space outside the suction port or toward a space outside the discharge port.

Figure 5:
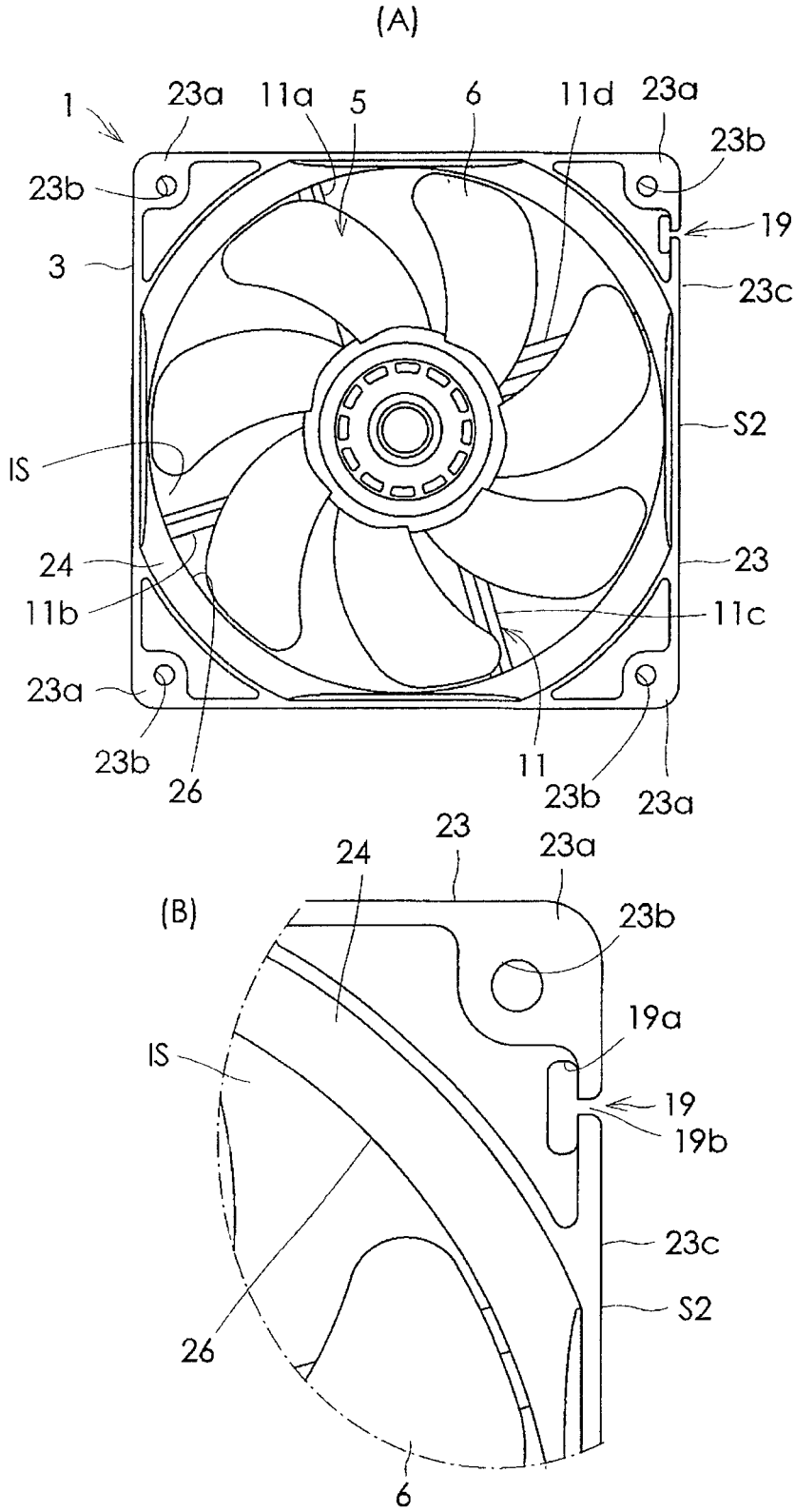
FIG. 5(A) is a rear view of FIG. 3(A)
FIG. 5(B) is a partially enlarged view of FIG. 5(A).

As discussed above, the first flange 21 and the second flange 23 has a substantially quadrangular outline shape as seen in the axial direction. According to the present embodiment, the first and the third lead wire engaging portions 17 and 27 are formed in one side S1 of the quadrangular outline of the first flange 21. Refer to FIG. 3. The second lead wire engaging portion 19 is formed in one side S2 of the quadrangular outline of the second flange 23, opposed to the side S1 where the first and the third lead wire engaging portions 17 and 27 are formed. Refer to FIG. 5. With such configuration, the third lead wire engaging portion 27 may be provided in the same side S1 of the first flange 21 in the vicinity of the first lead wire engaging portion 17. Thus the lead wire 15 need not be longer than necessary even when the lead wire 15 is to be pulled out in the axial direction toward a side where the discharge port is positioned. Further, since the second lead wire engaging portion 19 and the third lead wire engaging portion 27 are arranged along the axial direction, the lead wire 15 need not be longer than necessary even when a plurality of axial flow fans of the same shape are used by arranging them in the axial direction.

According to the present embodiment, the first lead wire engaging portion 17 may be constituted from a first through-hole 17*a* that is formed in the first flange 21 to pass therethrough in the axial direction and to communicate with the groove portion 13 of the web 11*d*, and a first slit 17*b* that is formed in the first flange 21 to communicate with the first through-hole 17*a*, passing through the first flange 21 in the axial direction, and opened in an outer peripheral surface 21*f* of the first flange 21. Refer to FIGS. 3(B) and 4. The second lead wire engaging portion 19 may be constituted from a second through-hole 19*a* that is formed in the second flange 23 to pass therethrough in the axial direction, and a second slit 19*b* that is formed in the second flange to communicate with the second through-hole 19*a*, passing through the second flange 23 in the axial direction, and opened to an outer peripheral surface 23*c* of the second flange 23. Refer to FIGS. 4(B) and 5(B). The third lead wire engaging portion 27 may be constituted from a third through-hole 27*a*, which is formed in a portion 21*g* of the first flange 21 that is opposed in the axial direction to the second lead wire engaging portion 19 provided in the second flange 23 and passes through the first flange 21 in the axial direction, and a third slit 27*b* formed in the first flange 21 to communicate with the third though-hole 27*a*, passing through the first flange 21 in the axial direction, and opened to an outer peripheral surface 21*f* of the first flange 21. Refer to FIGS. 3(B) and 4(B).

The first slit 17*b* may be dimensioned so that the plurality of lead wires 15 engaged with the first lead wire engaging portion 17 and passing through the first through-hole 17*a* may not readily come off from the first slit 17*b*. The second slit 19*b* may be dimensioned so that the plurality of lead wires 15 engaged with the second lead wire engaging portion 19 and passing through the second through-hole 19*a* may not readily come off form the second slit 19*b*. The third slit 27*b* may be dimensioned so that the plurality of lead wires 15 engaged with the third lead wire engaging portion 27 and passing through the third through-hole 27*a* may not readily come off from the third slit 27*b*.

More specifically, in the first lead wire engaging portion 17, the first through-hole 17*a* is a trapezoidal hole as viewed from the side where the first flange 21 is positioned, that is, as viewed from the front of the axial flow fan 1, passing in the axial direction through the portion 21*e* of the first flange 21. The width of the first slit 17*b* in an extending direction of the side S1 of the first flange 21 where the portion 21*e* is provided is smaller than the width of the through-hole 17*a*. In the second lead wire engaging portion 19, the second through-hole 19*a* is an elliptical hole in shape with its major axis extending in parallel with an extending direction of the side S2 of the second flange 23. The width of the second slit 19*b* in the extending direction of the side S2 of the second flange 23 is smaller than the width of the major axis of the second through-hole 19*a*. In the third lead wire engaging portion 27, the third through-hole 27*a* is an elliptical hole with its major axis extending in parallel with the extending direction of the side S1 of the first flange 21. The width of the third slit 27*b* in the extending direction of the side S1 of the first flange 21 is smaller than the width of the major axis of the third through-hole 27*a*. Configurations of the first, second and third through-holes 17*a*, 19*a* and 27*a* are not limited to those employed in the present embodiment, and may arbitrarily be determined as long as the lead wires 15 may not readily come off from the slits 17*b*, 19*b* and 27*b*.

With such configuration of the first lead wire engaging portion 17, the second lead wire engaging portion and the third lead wire engaging portion 27, the plurality of lead wires 15 may be engaged with the first lead wire engaging portion 17, the second lead wire engaging portion 19, and the third wire engaging portion 27 merely by inserting the plurality of lead wires 15 through the first slit 17*b*, the second slit 19*b* and the third slit 27*b* into the first through-hole 17*a*, the second through-hole 19*a* and the third through-hole 27*a* respectively. Thus engagement of the plurality of lead wires 15 may be simplified. Further, once the lead wires 15 have been engaged with the engaging portions, that is, the lead wires 15 have been inserted within the first to third through-holes 17*a*, 19*a*, 27*a*, the lead wires 15 may securely be engaged with the first to third lead wire engaging portions 17, 19, 27 since the lead wires 15 do not readily come off from the first to third slits 17*b*, 19*b*, 27*b*.

FIGS. 6 and 7 explain engagement of the plurality of lead wires 15 in the axial flow fan 1 according to the present embodiment. In respect of engagement of the lead wires 15 with the second lead wire engaging portion 19 as shown in FIGS. 6(A) and 6(B), the plurality of lead wires 15 received in the groove portion 13 of the web 11*d* are inserted through the slit 17*b* into the first through-hole 17*a*. Thus the plurality of lead wires 15 are pulled out into the outer space OS while being engaged with the first lead wire engaging portion 17. Next, the plurality of lead wires 15 pulled out into the outer space OS are inserted through the second slit 19*b* into the second through-hole 19*a*. Thus the plurality of lead wires 15 are engaged with the second lead wire engaging portion 19 while being engaged with the first lead wire engaging portion 17. As a result, the plurality of lead wires 15 are pulled out in the axial direction toward a side where the suction port or the suction opening 24 is positioned, and then into a space outside the axial flow fan 1.

In respect of engagement of the lead wires 15 with the third lead wire engaging portion 27 as shown in FIGS. 7(A) and 7(B), the process is similar to that of FIG. 6 until the wires have been engaged with the first lead wire engaging portion 17 and pulled out into the outer space OS. Then, the plurality of lead wires 15 pulled out into the outer space OS are inserted through the third slit 27*b* into the third through-hole 27*a*. In this manner, the plurality of lead wires 15 are engaged with the third lead wire engaging portion 27 while being engaged with the first lead wire engaging portion 17 and thereafter pulled out in the axial direction toward a space outside the discharge port or the discharge opening 22 of the axial flow fan 1.

The engagement of the lead wires 15 is not limited to those shown in FIGS. 6 and 7, and it is a matter of course that the plurality of lead wires 15 may be engaged with the second lead wire engaging portion 19 and the third lead wire engaging portion 27. That is, the plurality of lead wires 15 may be divided and separately pulled out in the axial direction toward both sides where the suction port is positioned and the discharge port is positioned.

INDUSTRIAL APPLICABILITY

According to the present invention, a third lead wire engaging portion is provided in the first flange at a given distance from the first lead wire engaging portion so that a plurality of lead wires pulled out into an outer space between the first flange and the second flange may be engaged with the third lead wire engaging portion and then pulled out toward one side in the axial direction where the first flange is positioned. Accordingly, the lead wires may be pulled out not only to a side where the second flange is positioned but also to a side where the first flange is positioned. Thus, there are many options available how to install or place an axial flow fan and how to guide the lead wires.

The invention claimed is:

1. An axial flow fan comprising:

a fan housing including a first flange positioned on one side of a rotary shaft in an axial direction of the rotary shaft;

a second flange positioned on the other side of the rotary shaft in the axial direction; and a cylindrical portion provided between the first flange and the second flange, the fan housing having an air channel defined by an inner space formed by the first flange, the second flange and the cylindrical portion, the air channel having a suction port and a discharge port;

an impeller disposed in the air channel and including a plurality of blades;

a motor including:

a power supply circuit;

a rotor to which the impeller is fixed, configured to rotated about the rotary shaft; and, a stator provided with respect to the rotor;

a motor casing for receiving the motor therein, including a bottom wall portion located within the first flange, and a peripheral wall portion formed continuous with the bottom wall portion and extending toward the second flange;

a plurality of webs disposed at intervals in a direction of rotation of the impeller and located within the air channel to connect the motor casing and the first flange, wherein a groove portion is formed in one of the webs to allow an internal space of the motor casing to communicate with an outer space defined between the first flange and the second flange of the fan housing and located outside of the cylindrical portion of the fan housing;

a plurality of lead wires received in the groove portion formed in the one of the webs, connected to the power supply circuit of the motor, and extending toward the outer space;

a first lead wire engaging portion formed in a connecting portion between the first flange and the one of the webs, the first lead wire engaging portion engaged with the plurality of lead wires such that the lead wires are pulled out from and extend through the first lead wire engaging portion into the outer space;

a second lead wire engaging portion formed in the second flange to be engaged with the plurality of lead wires such that the plurality of lead wires, which have been engaged with the first lead wire engaging portion and pulled out therefrom into the outer space, are then pulled out toward the other side of the rotary shaft in the axial direction where the second flange is positioned; and a third lead wire engaging portion formed in the first flange at a given distance from the first lead wire engaging portion to be engaged with the plurality of lead wires such that the lead wires, which have been pulled out from the first lead wire engaging portion into the outer space, are then pulled out toward the one side of the rotary shaft in the axial direction where the first flange is positioned, wherein:

the first lead wire engaging portion is constituted from a first through-hole formed in the first flange to pass therethrough in the axial direction and communicating with the groove portion of the one of the webs, and a first slit formed in the first flange to communicate with the first through-hole, passing through the first flange in the axial direction, and opened in an outer peripheral surface of the first flange;

the second lead wire engaging portion is constituted from a second through-hole formed in the second flange to pass therethrough in the axial direction, and a second slit formed in the second flange to communicate with the second through-hole, passing through the second flange, and opened in an outer peripheral surface of the second flange;

the third lead wire engaging portion is constituted from a third through-hole formed in the first flange to pass therethrough in the axial direction, and a third slit formed in the first flange to communicate with the third through-hole, passing through the first flange, and opened in the outer peripheral surface of the first flange;

the first slit is dimensioned so that the plurality of lead wires engaged with the first lead wire engaging portion and passing through the first through-hole may not readily come off from the first slit;

the second slit is dimensioned so that the plurality of lead wires engaged with the second lead wire engaging portion and passing through the second through-hole may not readily come off from the second slit; and the third slit is dimensioned so that the plurality of lead wires engaged with the third lead wire engaging portion and passing through the third through-hole may not readily come off from the third slit.

2. The axial flow fan according to claim 1, wherein the second lead wire engaging portion formed in the second flange and the third lead wire engaging portion formed in the first flange face each other in the axial direction.

3. The axial flow fan according to claim 1, wherein:

the first flange and the second flange each has a substantially quadrangular outline shape as seen in the axial direction; and the first lead wire engaging portion and the third lead wire engaging portion are formed in one side of the quadrangular outline of the first flange; and the second lead wire engaging portion is formed in one side of the second flange, opposed to the one side of the quadrangular outline of the first flange where the first and the third lead wire engaging portions are formed.

* * * * *